United States Patent [19]

Gerstmann et al.

[11] 4,148,195

[45] Apr. 10, 1979

[54] LIQUID PISTON HEAT-ACTUATED HEAT PUMP AND METHODS OF OPERATING SAME

[76] Inventors: Joseph Gerstmann, 5 Tally Ho La., Framingham, Mass. 01701; Yizhak Friedman, 31 Walsh Rd., Newton, Mass. 02159

[21] Appl. No.: 859,571

[22] Filed: Dec. 12, 1977

[51] Int. Cl.[2] ..... F25B 9/00; F01B 29/08

[52] U.S. Cl. ..... 62/6; 60/516

[58] Field of Search ..... 62/6; 60/516

[56] References Cited

U.S. PATENT DOCUMENTS

| | | | |
|---|---|---|---|
| 2,468,293 | 4/1949 | Du Pre | 62/6 |
| 2,836,033 | 5/1958 | Marrison | 60/516 |
| 3,552,120 | 1/1971 | Beale | 62/6 |
| 3,608,311 | 9/1971 | Roesel, Jr. | 60/516 |
| 3,613,385 | 10/1971 | Hogan et al. | 62/6 |
| 3,713,288 | 1/1973 | Andel | 60/516 |
| 3,812,682 | 5/1974 | Johnson | 62/6 |
| 3,901,033 | 8/1975 | McAlister | 60/516 |
| 3,987,629 | 10/1976 | Pecar | 60/516 |

*Primary Examiner*—Lloyd L. King

[57] ABSTRACT

A heat-actuated heat pump is disclosed having liquid pistons which displace the working gas and transmit power between expanding gas and compressing gas. Power output from expanding sections is transmitted to compressing sections without intervening mechanical shafts or levers, and the phasing of the various pistons is self-regulated, thereby eliminating the need for phase control mechanisms, such as crankshafts. The engine and heat pump operate in a thermally regenerated cycle without valves, closely approximating a Stirling cycle.

16 Claims, 6 Drawing Figures

LIQUID PISTON HEAT-ACTUATED HEAT PUMP AND METHODS OF OPERATING SAME

BACKGROUND OF THE INVENTION

In the art, devices such as heat engines and heat pumps are well known, the heat engine being a device which utilizes heat from a high temperature source to produce net power while rejecting waste heat to a low temperature sink, whereas a heat pump is a heat engine operating in a reversed cycle such that mechanical power is utilized to raise heat from a low temperature source to a high temperature sink. Conventionally, if the purpose of the heat pump is to supply heat, then it is called a heat pump. If, on the other hand, the purpose is to provide cooling, then it is called a refrigerator. If a heat engine is mechanically coupled to a heat pump (or refrigerator), such that the heat engine provides the mechanical power to operate the heat pump, then the combination is known as a heat-actuated heat pump.

In the operation of such devices, it is also well known to employ "liquid piston" means used in a hydraulic sense to transmit power from an expanding gas or to a compressing gas. Likewise, the concept of directly coupling a Stirling heat engine to a Stirling type heat pump is not new and it has also been proposed to provide free piston Stirling engines with fluid dynamic phasing between a power piston and a displacer.

In this connection, there are noted below a number of related patents and a brief description of the structure and operation in each instance.

1. R. V. L. Hartley, U.S. Pat. No. 2,532,096, Nov. 28, 1950

A closed U-shaped tube contains a volatile liquid and a boiler section and a condenser section. Vapor formed in the boiler section displaces liquid out of the boiler until the vapor has access to the condenser, in which it condenses, permitting the volatile liquid to re-enter the boiler. Oscillatory motions of the liquid column are set up in this manner, and power may be extracted from the motion of the liquid column, as through a flexible plate or membrane.

2. E. Van Andel, U.S. Pat. No. 3,713,288, Jan. 30, 1973

A plurality of parallel tubes are closed at one end and open at the other end to a diaphragm chamber. The closed end of the tubes is heated and the open end is cooled. The tubes contain a volatile liquid which is heated and vaporized at the closed end, and the vapor thus formed is condensed at the open end. The alternate boiling and condensing causes the volatile liquid columns to oscillate, and mechanical power may be extracted through the resulting motions of the membrane.

Loose fitting pistons interconnected so as to move in unison may be placed into the open ends of the tube so as to synchronize the motions of the individual liquid columns.

3. K. G. Hagen, et al., U.S. Pat. No. 3,986,360, Oct. 19, 1976 F. N. Huffman, et al., U.S. Pat. No. 3,815,363, June 11, 1974

A volatile liquid is displaced between a condenser and a vaporizer, separated by a tidal regenerator which regeneratively stores and releases the heat of the volatile liquid between the vaporizing and condensing temperatures. The displacement is effected by an externally actuated mechanical piston which raises the volatile liquid from the condenser through the regenerator to the boiler. Mechanical power may be extracted from the expansion of the vapor through a piston or a bellows. Multiple heat engines may be cascaded, with the heat input to a lower stage derived from the rejected heat from a higher stage.

4. M. Pecar, U.S. Pat. No. 3,987,629, Oct. 26, 1976

A volatile liquid is heated in a closed chamber such that the increased pressure of the vapor over the liquid forces the liquid out of the chamber and through a turbine to oved, the chamber is allowed to communicate with the condenser, and then the second chamber is heated so that process can be repeated.

5. R. E. McAlister, U.S. Pat. No. 3,901,033, Aug. 26, 1975

This invention is similar to Pecar's (3,987,629) and relates to a number of embodiments of basically similar heat engines.

6. A. M. Thomsen, U.S. Pat. No. 2,391,078, Dec. 18, 1945

A liquid, which advantageously may be a volatile liquid, is caused to oscillate in a U-tube through the action of a mechanically actuated, loose fitting piston. The ends of the U-tube are interconnected by a thermal regenerator. Fuel and air are burned on one side of the U-tube in the space between the liquid level and the regenerator when the water level on that side is near its peak. The liquid in the U-tube then displaces gas from the one side through the regenerator to the hot side, thereby increasing the pressure of the gas. This gas is caused to flow through a power extraction device, as for example a turbine, while simultaneously it acts against a piston in a cylinder. A similar U-tube assembly is connected to the other side of the piston, and executes a similar cycle 180° out-of-phase with the first. In this invention, the liquid piston acts simply as a displacer, but can also be used to add to the mass of the working fluid flowing through the turbine by evaporation.

7. W. T. Beale, U.S. Pat. No. 3,552,120, Jan. 5, 1971

This invention pertains to a free piston Stirling engine or Stirling refrigerator in which the phasing between the power piston and the displacer is achieved without the use of mechanical couplings, but instead utilizes a fluid coupling, as for example a compressible gas.

8. J. F. Rosel, Jr., U.S. Pat. No. 3,608,311, Sept. 28, 1971

This invention is basically similar to that of Pecar's (U.S. Pat. No. 3,987,629).

9. F. K. DuPre, U.S. Pat. No. 2,468,293, Apr. 26, 1949

This invention relates to a conventional Stirling engine directly coupled to a Stirling refrigerator to operate as a heat-actuated heat pump. The same working fluids may be used within the heat engine and the heat pump. Mechanical power is transmitted through a wobble-plate drive. An 8-cylinder arrangement is disclosed having 4 power pistons and 4 refrigerator pistons. The engine and refrigerator are double acting, with adjacent pistons bearing 90° phase relationships to each other.

10. W. A. Marrison, U.S. Pat. No. 2,836,033, May 27, 1958

Marrison disclosed a thermally-powered acoustic wave amplifier. He describes the best location and the optimal sizing of the cooler and heater for highest performance. His device may utilize acoustic oscillations of a gas column, or may be used with a volatile liquid in which the liquid is alternately evaporated and condensed, with the resulting pressure oscillations driving a liquid column in an oscillatory manner so that power can be extracted. Whether using a gas or a volatile liquid, his device operates on the same principle as Hartley (U.S. Pat. No. 2,532,096), Van Andel (U.S. Pat. No. 3,713,288), and Hagen (U.S. Pat. No. 3,986,360), in that fluid oscillations are caused by alternate heating and cooling of a fluid moving between adjacent heaters and coolers.

It is believed therefore that none of these patents disclose the use of double acting liquid pistons combined with heat engine and heat pump means as described in this invention.

SUMMARY OF THE INVENTION

The present invention relates to heat actuated heat pumps and more particularly to a heat actuated heat pump apparatus in which liquid columns referred to as "liquid pistons" are utilized in a confined conduit system.

It is a chief object of the invention to provide an improved liquid piston heat actuated heat pump apparatus and improved methods of operating the apparatus to supply heat or to provide cooling. It is also an object of the invention to provide a heat actuated heat pump apparatus wherein the power from a heat engine is transmitted to a heat pump or refrigerator without the use of mechanical power transmission devices and wherein the use of liquid pistons provides for expansion and compression processes to occur almost isothermally within a heat exchanger. Still another object is to provide a system which utilizes the same working fluid in both the heat engine means and the heat pump means so that carry-over of material from one side to the other can be tolerated and the system is characterized by high reliability and durability as well as simplicity of operation.

It is found that these objectives may be realized by a heat actuated pump apparatus in which liquid pistons are confined and are utilized to displace a working gas and transmit power between an expanding gas and a compressing gas. Heat engine means and heat pump means operate in a thermally regenerated cycle with the processes closely approximating a Stirling cycle. The liquid pistons are arranged to operate as double acting liquid pistons in a heat actuated heat pump in which each piston communicates with a heat pump on one side and a heat engine on the other side and adjacent pistons move with approximately 90° phase relationship to each other.

DETAILED DESCRIPTION OF INVENTION

Figure 1:
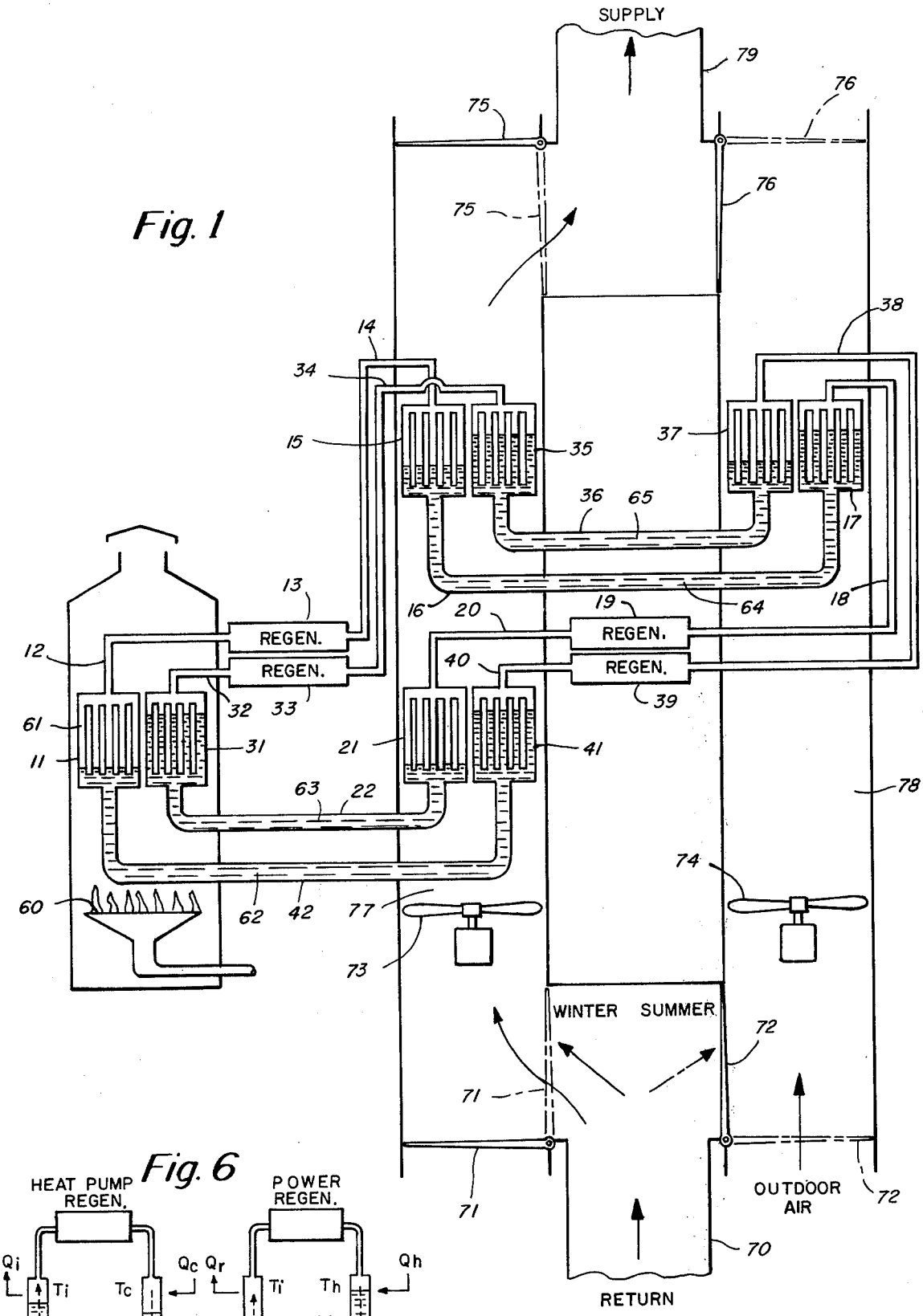
FIG. 1 is a diagrammatic view of a heat actuated heat pump apparatus which may be used for either supplying heat or cooling and in which are illustrated schematically liquid pistons of the invention and means for confining and actuating these liquid pistons.
Figure 6:
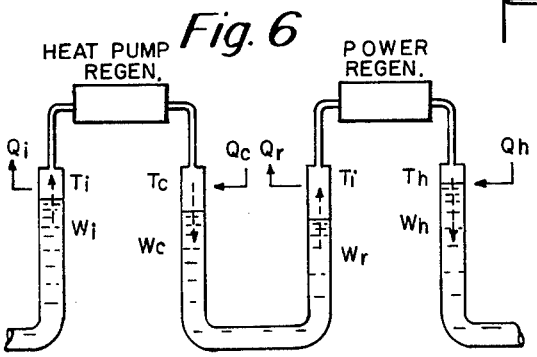
FIG. 6 is another diagrammatic view showing a simplified form of liquid piston means schematically.

Referring more in detail to the drawings, FIG. 1 is intended to indicate one simple form of liquid piston apparatus shown schematically; FIGS. 2–5 are illustrative of the liquid piston apparatus combined with a more detailed showing of duct and conduit means by which heating and cooling can be practically carried out; FIG. 6 is a simplified form of liquid piston means which is useful in describing liquid piston operation and performance.

Considering first the simplified form of liquid piston means shown in FIG. 6, its operation may be explained as follows: Considering first the power regenerator at the right, assume that the right-hand piston executes a harmonic motion such that its position with respect to the power regenerator leads that of the center piston by 90°. Thus, when the right-hand piston is closest to the regenerator, most of the gas will be to the left of the regenerator while the middle piston is moving towards the regenerator, thereby compressing the gas at an intermediate temperature $T_i$. When the middle piston has compressed most of the gas, the right-hand piston will be moving away from the regenerator, causing the gas to be displaced from the left of the regenerator at $T_i$ to the right at higher temperature $T_h$, thereby causing the pressure of the gas to increase due to its rise in temperature. Thus, as the right-hand piston descends, the work of expansion will be greater than the work of compression imparted by the middle piston. After the right-hand piston reaches the limit of its travel and begins to return towards the power regenerator, the middle piston will be in the process of moving away from the regenerator, so that during the return stroke of the right-hand piston gas will be displaced through the regenerator causing its temperature to drop, and thereby lowering the pressure of the gas. Thus, the right-hand liquid piston receives more work from the gas during its expansion than during its compression and displacement back through the regenerator resulting in net work $W_h$. Conversely, more work is imparted by the center piston to the gas during compression than it receives back during the displacement of the gas into the cooler space, resulting in net work $W_r$.

Turning attention to the heat pump regenerator, the middle piston again leads the motion of the left-hand piston by 90°. Here, however, net work ($W_c$) is done by the gas at low temperature $T_c$ on the center liquid piston, while the left-hand piston does net work ($W_i$) on the gas at intermediate temperature $T_i$. If the gas spaces on either sides of the regenerators are maintained at steady temperatures, and if the motions are to be cyclic, then the First Law of Thermodynamics requires that the following relationships hold:

$$Q_i = W_i$$

$$Q_h = W_h$$

$$Q_c = W_c = W_r = Q_r$$

Also, since no net work will be taken from the system, the work $W_h$ must be equal to $W_i$. This requirement could be met by connecting the left-hand piston to the right-hand piston. However, the preceding argument has required that the left-hand piston must lag the motion of the right-hand piston by 180°. Thus, in order to satisfy the phasing requirements, the arrangement shown must be repeated before the end pistons can be joined. Thus, a complete loop consists of two alternating sets of power and heat pump regenerators with intervening liquid pistons, each piston maintaining a 90° phase relationship to its neighbor. The events surrounding each regenerator correspond to a harmonic motion Stirling cycle, with the work of compression of the power cycle provided by the work of expansion from the heat pump cycle, and the work of expansion from the power cycle providing the work of compression for the heat pump cycle.

Ideally, if all processes were executed reversibly, then application of the Second Law of Thermodynamics requires that:

$$\frac{Q_i}{T_i} = \frac{Q_c}{T_c}\text{; and } \frac{Q_h}{T_h} = \frac{Q_r}{T_i}$$

For this ideal case, the ideal coefficients of performance would be:

$$COP_H = \frac{Q_i + Q_r}{Q_h} = 1 + \frac{T_c}{T_i};$$

and $$COP_R = \frac{Q_c}{Q_h} = \frac{T_c}{T_i},$$

where the subscripts H and R refer to the heating and refrigeration modes, respectively. Also, since $Q_i = Q_h$ and $Q_c = Q_r$, it is required that:

$$\frac{T_i}{T_c} = \frac{T_h}{T_i}$$

That is, for the embodiment of FIG. 1, assuming ideal operation, the "power" cycle must operate over the same temperature ratio as the "refrigeration" cycle. However, to provide for losses within the system, in actuality, the temperature ratio of the "power" cycle will be greater than that of the "refrigeration" cycle.

FIGS. 1–5 include a complete loop consisting of two alternating sets of power and heat pump regenerators with intervening liquid piston means. The liquid pistons are arranged to occur as double-acting liquid pistons in a heat actuated heat pump in which each piston communicates with a heat pump on one side and a heat engine on the other side and each piston maintains approximately a 90° phase relationship to its neighbor.

Figure 2:
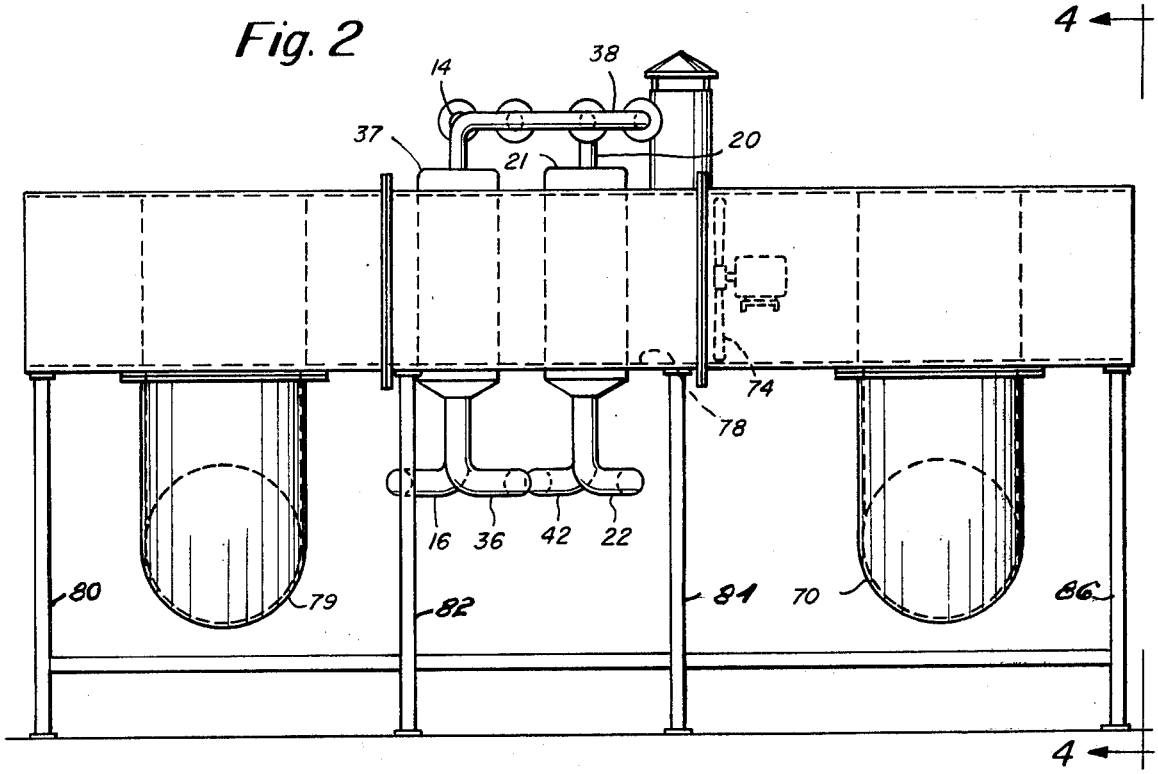
FIG. 2 is a side elevational view of the apparatus of the invention shown in a typical working embodiment in which ducts or conduit means are indicated in more detail in combination with the liquid piston means.
Figure 3:
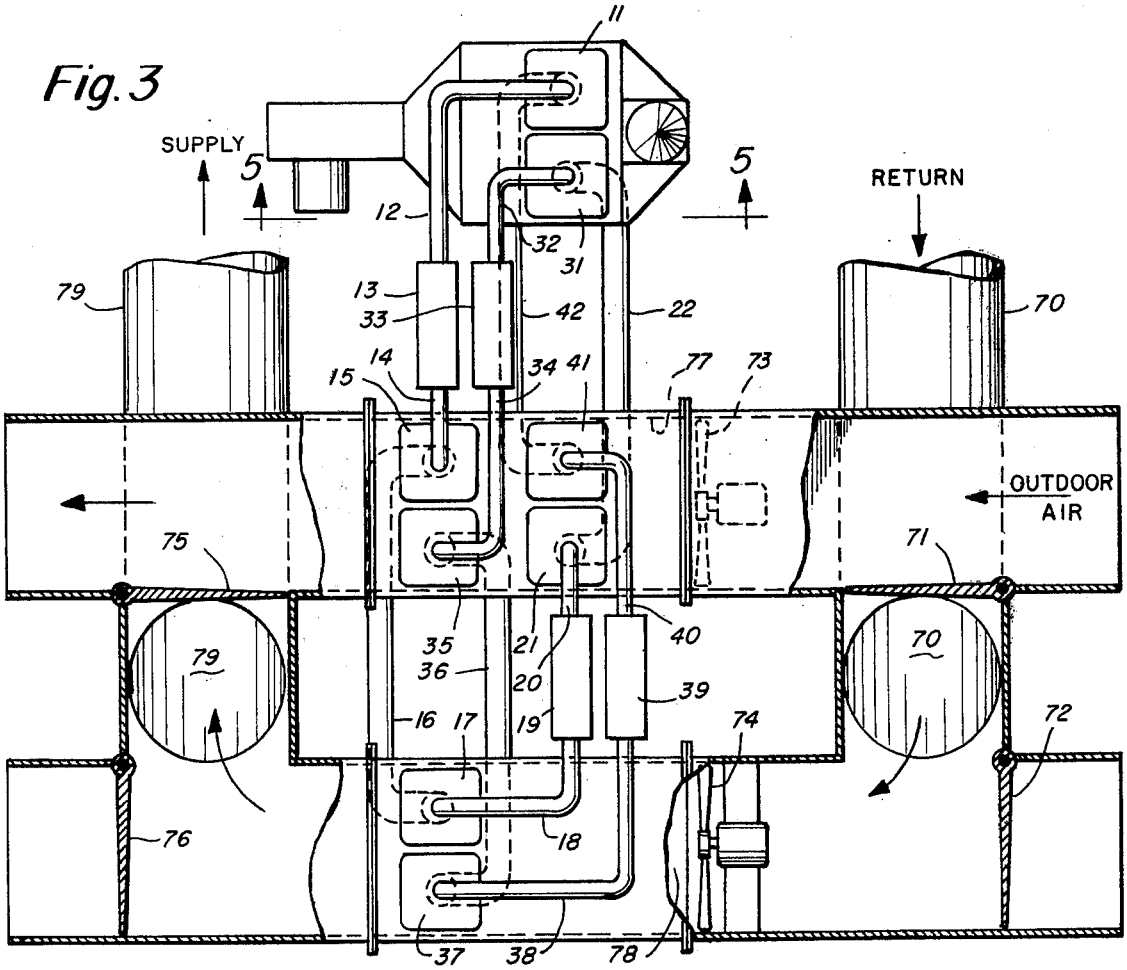
FIG. 3 is a plan view of the apparatus shown in FIG. 2.
Figure 4:
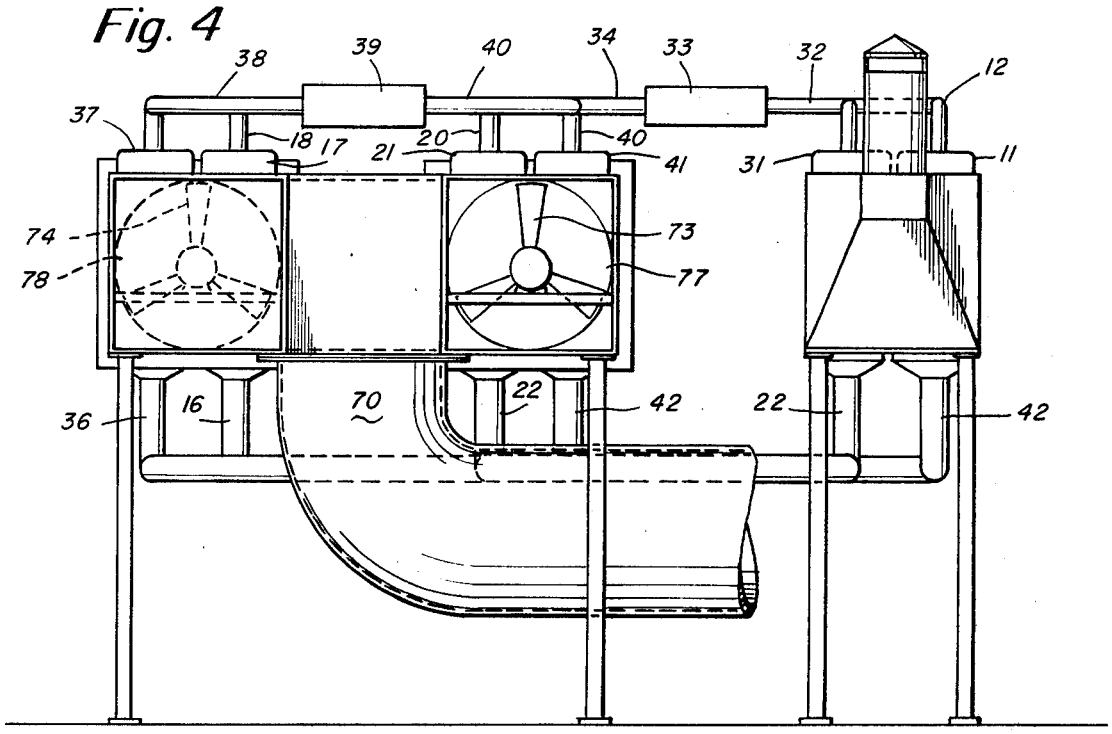
FIG. 4 is an end elevational view taken along the line 4—4 of FIG. 2.
Figure 5:
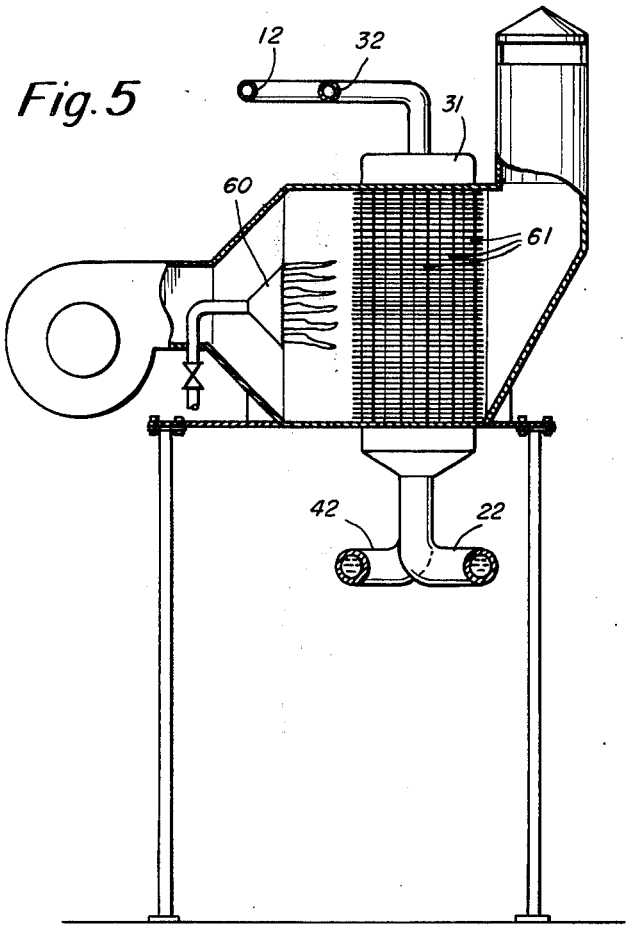
FIG. 5 is a cross section taken on the line 5—5 of FIG. 3.

It should be understood that the method and apparatus of the invention may be utilized in various ways. However, the apparatus shown in FIGS. 1–5 comprises one desirable arrangement which may be employed for residential space conditioning including a heating mode for winter operation and a cooling mode for warm weather operation. In the embodiment shown in FIGS. 1–5, the apparatus may be mounted on supporting legs 80, 82, 84 and 86 as shown in FIG. 2. In general, the apparatus includes a source of heat such as the burner 60 which may be controlled by an indoor thermostat. Arranged at one side of the burner member are the heat pump components and arranged to provide for circulation of air through the heat pump components are conduit means 70 and 79 and duct means 78.

As shown in FIGS. 1–5, the heat actuated heat pump comprises power regenerator 13 connected via conduit 14 to engine compressor 15, which is connected via conduit 16 to heat pump expander 17. Expander 17 is connected via conduit 18 to heat pump regenerator 19 which is connected via conduit 20 to heat pump compressor 21. Heat pump compressor 21 is connected via conduit 22 to engine expander 31.

Components 32, 33, 34, 35, 36, 37, 38, 39, 40, 41 and 42 are connected in like fashion between engine expander 31 and engine expander 11.

Liquid pistons 62, 63, 64 and 65 are as illustrated diagrammatically in FIG. 1 contained in conduits 42, 22, 16 and 36, respectively, to enable pressure communication between expander 11 and compressor 41, expander 31 and compressor 21 expander 17 and compressor 15, and expander 37 and compressor 35, respectively. The expanders and compressors as will be noted are comprised of a multiplicity of tubular elements as 61 to permit intermittent thermal communication between the working gas contained within the tubular elements and the heating or cooling medium outside the tubular elements. Expanders 11 and 31 communicate with the combustion products from burner 60.

When the function of the device is to provide space cooling, return air from the conditioned space is brought through duct 70 through open damper 72 and pumped by fan 74 through duct 78 to communicate thermally with heat pump expanders 17 and 37. Dampers 75 and 76 are positioned to direct the cooled air back to supply duct 79 as shown in FIG. 1. Simultaneously, damper 71 is adjusted to accept outdoor air to be drawn by fan 73 through duct 77 to permit thermal communication of the outdoor air with heat pump compressors 21 and 41 and engine compressors 15 and 35 after which the air is discharged to the outside.

When the object is to provide heating, then dampers 71, 72, 75 and 76 are adjusted to permit outdoor air to be drawn by fan 74 into duct 78 to permit thermal communication with heat pump expanders 17 and 37 after which the outdoor air is discharged to the outdoors; and indoor air is drawn through return duct 70 by fan 73 through duct 77 to permit thermal communication with heat pump compressors 21 and 41 and engine compressors 15 and 35, after which said indoor air is returned to the indoor supply duct 77.

In operation, it is pointed out that liquid columns 62, 63, 64 and 65 function as liquid pistons and execute harmonic motions such that the motion (considering the clockwise direction to be positive) of liquid piston 62 lags the motion of liquid piston 64 by approximately 90°; the motion of liquid piston 64 lags the motion of liquid piston 63 by approximately 90°; and the motion of liquid piston 63 lags the motion of liquid piston 65 by approximately 90°. The work of expansion of expanders 11 and 31 is transmitted by liquid pistons 62 and 63 to provide the power for compression in compressors 41 and 21. Similarly, the work of expansion of expanders 17 and 37 is transmitted by liquid pistons 64 and 65 to compressors 15 and 35.

From the foregoing disclosure, it will be apparent that there has been devised an improved liquid piston heat actuated heat pump together with the improved methods of operating same and advantages of the invention are that the system can be hermetically sealed without requiring the use of reciprocating or rotary shafts or shaft seals; that the required motions are smooth and silent and that there are no mechanical moving parts to fail or to wear out; that the use of liquid pistons makes it practical to approach isothermal expansion and compression, as opposed to adiabatic expansion and compression which occurs in conventional engines; that unlike prior art liquid piston engines, the engine and heat pump means of the invention eliminate the losses associated with the use of separate displacer pistons, and that the simplicity and inherent durability of the apparatus combined with the potential for relatively high efficiency makes it possible to produce a cost-effective heat actuated heat pump suitable for space heating and or cooling.

We claim:

1. In a method of supplying heat or cooling through the thermally induced motions of fluids, one of which is a substantially incompressible liquid, the other of which is a compressible gas, the steps which include confining the liquid and gas in continuously connected enclosure means comprising fluid conduits and heat exchangers, said enclosure means including a first heat exchanger connected at its top through a first conduit means to the top of a second heat exchanger, said second heat exchanger connected at its bottom through a second conduit means to the bottom of a third heat exchanger, said third heat exchanger connected at its top through a third conduit means to the top of a fourth heat exchanger, said fourth heat exchanger connected at its bottom through a fourth conduit means to the bottom of a fifth heat exchanger, said fifth heat exchanger connected at its top through a fifth conduit means to the top of a sixth heat exchanger, said sixth heat exchanger connected at its bottom through a sixth conduit means to the bottom of a seventh heat exchanger, said seventh heat exchanger connected at its top through a seventh conduit means to the top of an eighth heat exchanger and said eighth heat exchanger connected at its bottom through an eighth conduit means to the bottom of said first heat exchanger, said substantially incompressible liquid being releasably confined as separate liquid bodies to constitute free liquid pistons in the second, fourth, sixth and eighth conduits and each of the liquid bodies being partially and reversibly transferable into both respective heat exchangers with which that conduit connects, and said compressible gas being releasably confined as separate gaseous bodies in each of said first, third, fifth and seventh conduits, each of the gaseous bodies being partially and reversibly transferable through respective conduits into both respective heat exchangers with which that conduit connects, heating said first and fifth heat exchangers to a relatively high temperature by directing a flow of heat into said heat exchangers, introducing heat into said third and seventh heat exchangers from an external medium at a relatively low temperature, and releasing heat from said second, sixth, fourth and eighth heat exchangers to a cooling medium in a range of intermediate temperatures.

2. The method of claim 1 in which said first, third, fifth and seventh conduit means contain thermal regenerator means.

3. The method of claim 2 in which said substantially incompressible liquid is substantially non-volatile.

4. The method of claim 3 in which the flow of heat directed to said first and fifth heat exchangers is obtained from combustion of fuel.

5. The method of claim 4 in which said external medium at a relatively low temperature is a stream of air directed over said third and seventh heat exchangers.

6. The method of claim 5 in which said cooling medium in a range of intermediate temperatures is a stream of air flowing over said second, sixth, fourth and eighth heat exchangers.

7. The method of claim 6 in which said air flowing over said second, sixth, fourth and eighth heat exchangers is air substantially received from and elsewhere directed to the space to be heated, and in which said air flowing over said third and seventh heat exchangers is air substantially received from and elsewhere directed to the environment.

8. The invention of claim 6 in which said air flowing over said second, sixth, fourth and eighth heat exchangers is air substantially received from and elsewhere directed to the environment, and said air flowing over said third and seventh heat exchanger is air substantially received from and elsewhere directed to the space to be cooled.

9. Apparatus for supplying heat or cooling through the thermally induced motions of fluids, one of which is a substantially incompressible liquid, the other of which is a compressible gas, said apparatus comprising means for enclosing said liquid and gas in continuously connected relationship, said enclosure means including a first heat exchanger body connected at its top through a first conduit means to the top of a second heat exchanger body, said second heat exchanger body connected at its bottom through a second conduit means to the bottom of a third heat exchanger body, said third exchanger body connected at its top through a third conduit means to the top of a fourth heat exchanger body, said fourth heat exchanger body connected at its bottom through a fourth conduit means to the bottom of a fifth heat exchanger body, said fifth heat exchanger body connected at its top through a fifth conduit means to the top of a sixth heat exchanger body, said sixth heat exchanger body connected at its bottom through a sixth conduit means to the bottom of a seventh heat exchanger body, said seventh heat exchanger body connected at its top through a seventh conduit means to the top of an eighth heat exchanger body, and said eighth heat exchanger body connected at its bottom through an eight conduit means to the bottom of said first heat exchanger, said substantially incompressible liquid being releasably confined as separate liquid bodies to constitute free liquid pistons in the second, fourth, sixth and eighth conduits and each of the liquid bodies being partially and reversibly transferable into both respective heat exchangers with which that conduit connects, and said compressible gas being releasably confined as separate gaseous bodies in each of said first, third, fifth and seventh conduits, each of the gaseous bodies being partially and reversibly transferable through respective conduits into both respective heat exchangers with which that conduit connects, means for heating said first and fifth heat exchangers to a relatively high temperature by directing a flow of heat into said heat exchangers, means for supplying heat to said third and seventh heat exchangers from an external medium at a relatively low temperature, and means for circulating a cooling medium into which heat is released in a range of intermediate temperatures from the said second, sixth, fourth and eighth heat exchangers.

10. The invention of claim 9 in which the means for supplying heat to the said first and fifth heat exchangers comprises a burner.

11. The invention of claim 9 in which the means for supplying heat to the said first and fifth heat exchangers comprises a fluid heating medium.

12. The invention of claim 9 in which the means for supplying heat to the said first and fifth heat exchangers comprises a solar energy heat source.

13. The invention of claim 9 in which the means for supplying heat to the said first and fifth heat exchangers consists of exhausted waste heat.

14. The invention of claim 9 in which the incompressible liquid is a volatile liquid, the compressible gas contains vapor from the liquid and in which evaporation is carried out in at least heat exchangers 1 and 5 and condensation is carried out in at least heat exchangers 2 and 6.

15. The invention of claim 9 in which the means for supplying heat to said third and seventh heat exchangers includes an air conduit means located around said third and seventh heat exchangers and fan means for circulating said flow of air through the conduit means into and out of a space to be cooled.

16. The invention of claim 9 in which the means for supplying cooling to said second, fourth, sixth and eighth heat exchangers includes an air conduit means located around said second, fourth, sixth and eighth heat exchangers and fan means for circulating said flow of air through the conduit means into and out of a space to be heated.

* * * * *